US012426621B2

(12) United States Patent
Han et al.

(10) Patent No.: US 12,426,621 B2
(45) Date of Patent: Sep. 30, 2025

(54) METHOD AND APPARATUS FOR MANUFACTURING AEROSOL-FORMING ROD

(71) Applicant: KT&G CORPORATION, Daejeon (KR)

(72) Inventors: Young Rim Han, Daejeon (KR); Tae Chul Shin, Daejeon (KR); Do Kyung Lee, Daejeon (KR); Jung Kyu Seo, Daejeon (KR); Hee Tae Jung, Cheongju-si (KR)

(73) Assignee: KT&G CORPORATION, Daejeon (KR)

( * ) Notice: Subject to any disclaimer, the term of this patent is extended or adjusted under 35 U.S.C. 154(b) by 1169 days.

(21) Appl. No.: 17/043,455

(22) PCT Filed: Aug. 9, 2019

(86) PCT No.: PCT/KR2019/010116
§ 371 (c)(1),
(2) Date: Sep. 29, 2020

(87) PCT Pub. No.: WO2020/032715
PCT Pub. Date: Feb. 13, 2020

(65) Prior Publication Data

US 2021/0092989 A1 Apr. 1, 2021

(30) Foreign Application Priority Data

Aug. 9, 2018 (KR) ..... 10-2018-0093056

(51) Int. Cl.

| | |
|---|---|
| ***A24C 5/01*** | (2020.01) |
| ***A24B 3/14*** | (2006.01) |
| ***A24D 1/20*** | (2020.01) |

(52) U.S. Cl.
CPC ..... *A24C 5/01* (2020.01); *A24B 3/14* (2013.01); *A24D 1/20* (2020.01)

(58) Field of Classification Search
None
See application file for complete search history.

(56) References Cited

U.S. PATENT DOCUMENTS 4,497,331 A 2/1985 Nellen
4,596,259 A * 6/1986 White ..... A24B 15/30 131/369

(Continued)

FOREIGN PATENT DOCUMENTS

CN 102481015 A 5/2012
CN 104411191 A 3/2015

(Continued)

OTHER PUBLICATIONS

Lenzi, JC. N393; Tobacco Leaf Purchasing and Blending. Aug. 10, 1995. Philip Morris Records; Master Settlement Agreement. Unknown. https://www.industrydocuments.ucsf.edu/docs/ylhx0093 (Year: 1995).*

(Continued)

*Primary Examiner* — Michael J Felton
(74) *Attorney, Agent, or Firm* — Sughrue Mion, PLLC

(57) ABSTRACT

Embodiments of the present disclosure relate to a method and an apparatus for manufacturing an aerosol-forming rod, and according to the present disclosure, it is possible to realize various aerosol-forming product properties, by utilizing the sheet-specific characteristics of each manufacturing process of reconstituted tobacco sheets and mixing two or more types of reconstituted tobacco sheets having different types, different physical properties, or different main components to control the physical properties and taste of the tobacco rod.

8 Claims, 4 Drawing Sheets

(56) References Cited

U.S. PATENT DOCUMENTS

| | | | | |
|---|---|---|---|---|
| 4,819,668 | A * | 4/1989 | Shelar | A24D 1/00 131/365 |
| 8,839,801 | B2 | 9/2014 | Miyazawa et al. | |
| 2006/0021626 | A1* | 2/2006 | Mua | A24B 15/14 131/365 |
| 2007/0023056 | A1 | 2/2007 | Cantrell et al. | |
| 2015/0150302 | A1* | 6/2015 | Metrangolo | A24C 5/1821 131/230 |
| 2017/0181465 | A1* | 6/2017 | Yang | A24B 3/14 |
| 2018/0360099 | A1 | 12/2018 | Ibrahim | |

FOREIGN PATENT DOCUMENTS

| | | | |
|---|---|---|---|
| CN | 104824824 | A | 8/2015 |
| CN | 108366614 | A | 8/2018 |
| JP | 2015-517818 | A | 6/2015 |
| KR | 1993-0017518 | A | 9/1993 |
| KR | 10-1230582 | B1 | 2/2013 |
| KR | 10-2015-0024324 | A | 3/2015 |
| KR | 10-2018-0069092 | A | 6/2018 |
| VN | 41843 | A | 4/2015 |
| WO | 2015/197553 | A1 | 12/2015 |
| WO | 2016/050873 | A1 | 4/2016 |
| WO | 2017/097840 | A1 | 6/2017 |
| WO | 2017/203016 | A1 | 11/2017 |

OTHER PUBLICATIONS

What Makes Marlboro a Marlboro? 1997, 2002, Brown & Williamson Records; Master Settlement Agreement Source: URL: https://www.industrydocuments.ucsf.edu/docs/gpfc0135 (Year: 2002).*

International Search Report for PCT/KR2019/010116 dated Nov. 21, 2019 [PCT/ISA/210].

Office Action issued Nov. 3, 2021 in Chinese Application No. 201980019801.3.

Extended European Search Report issued Nov. 17, 2021 in European Application No. 19847236.7.

Office Action issued May 3, 2021 in Korean Application No. 10-2019-0097645.

* cited by examiner

METHOD AND APPARATUS FOR MANUFACTURING AEROSOL-FORMING ROD

CROSS REFERENCE TO RELATED APPLICATIONS

This application is a National Stage of International Application No. PCT/KR2019/010116, filed on Aug. 9, 2019, which claims priority from Korean Patent Application No. 10-2018-0093056, filed on Aug. 9, 2018.

TECHNICAL FIELD

Embodiments of the present disclosure relate to a method and apparatus for manufacturing an aerosol-forming rod.

BACKGROUND ART

Recently, the demand for alternative methods of overcoming the shortcomings of traditional cigarettes has increased. For example, there is growing demand for a method of generating an aerosol by heating an aerosol-generating material, rather than by combusting cigarettes. Accordingly, research into heating-type cigarettes and heating-type aerosol-generating devices has been actively conducted.

Conventional reconstituted tobacco for a heating-type aerosol-generating article is composed of a single type of reconstituted tobacco sheet manufactured by a paper-making process or slurry process. Thus, there was a limit to compensating for the disadvantages of a reconstituted tobacco sheet, such as filling power, combustion rate, taste, and the like.

DESCRIPTION OF EMBODIMENTS

Technical Field

Embodiments of the present disclosure provide a method and apparatus capable of controlling the physical properties and tastes of an aerosol-forming rod by utilizing the sheet-specific properties of aerosol-forming rod manufacturing processes, such as a slurry process, a paper-making process, or an extrusion process, and by using a mixed reconstituted tobacco sheet obtained by mixing two or more types of reconstituted tobacco sheets having different types, different physical properties, or different main components.

Solution to Problem

According to an embodiment of the present disclosure, a method of manufacturing an aerosol-forming rod includes: providing a first reconstituted tobacco manufactured by a first reconstituted tobacco sheet manufacturing process and a second reconstituted tobacco manufactured by a second reconstituted tobacco sheet manufacturing process; and manufacturing the aerosol-forming rod by using a mixed reconstituted tobacco obtained by mixing the first reconstituted tobacco and the second reconstituted tobacco at a predetermined mixing ratio.

In the method, physical properties of the aerosol-forming rod may differ according to the mixing ratio.

The physical properties may include at least one of thickness, basis weight, porosity, hardness, resistance-to-draw, and filling power.

The first reconstituted tobacco sheet manufacturing process and the second reconstituted tobacco sheet manufacturing process may be different from each other, and selected from a slurry process, a paper-making process, and an extrusion process, and the second reconstituted tobacco manufactured by the second reconstituted tobacco sheet manufacturing process is mixed at a mixing ratio of at least 10%.

The first reconstituted tobacco sheet manufacturing process may be a slurry process, the second reconstituted tobacco sheet manufacturing process may be one of the paper-making process and the extrusion process, and the mixing ratio of the second reconstituted tobacco is at least 10%.

According to another embodiment of the present disclosure, an apparatus for manufacturing an aerosol-forming rod, the apparatus includes: a first reconstituted tobacco sheet manufacturing apparatus for manufacturing a first reconstituted tobacco; and a mixing apparatus for manufacturing the aerosol-forming rod by using a mixed reconstituted tobacco obtained by mixing the first reconstituted tobacco and the second reconstituted tobacco at a predetermined mixing ratio.

According to another embodiment of the present disclosure, a method of manufacturing an aerosol-forming rod includes: providing a first reconstituted tobacco manufactured by a first reconstituted tobacco sheet manufacturing process and leaf tobacco shreds; and manufacturing the aerosol-forming rod by using a mixed reconstituted tobacco obtained by mixing the first reconstituted tobacco and the leaf tobacco shreds at a predetermined mixing ratio.

The leaf tobacco shreds may include at least one of flue-cured tobacco, burley tobacco, oriental tobacco, cigar leaves and toasted tobacco.

Advantageous Effects of Disclosure

According to the above, it is possible to realize various aerosol-forming product properties, by utilizing the sheet-specific characteristics of each manufacturing process of reconstituted tobacco sheet and mixing two or more types of reconstituted tobacco sheets having different types, different physical properties, or different main components to control the physical properties and tastes of tobacco rod.

MODE OF DISCLOSURE

Figure 1:
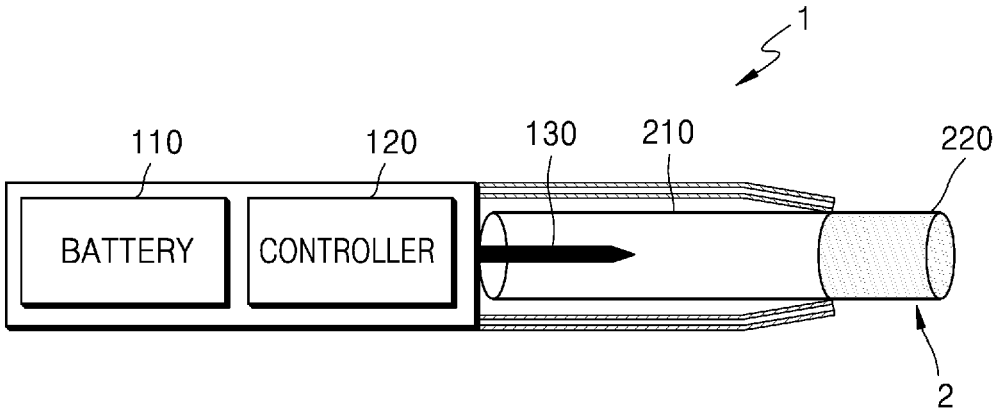
FIG. 1 is a diagram illustrating an example in which a cigarette is inserted into a holder.

Hereinafter, exemplary embodiments will be described in detail with reference to the accompanying drawings. The following description is only for the purpose of embodying the embodiments and does not limit the scope of the present disclosure. What can be easily inferred by experts in the art from the detailed description and examples should be construed as falling within in the scope of the present disclosure.

The terms "consist(s) of" or "include(s) (or comprise(s))" should not be interpreted or understood as including, without exception, all of the plurality of elements or the plurality of steps disclosed in the description. In other words, it should be understood that some of the elements or some of the steps may not be included, or that additional elements or steps may be further included.

With respect to the terms used to describe the various embodiments, general terms which are currently and widely used are selected in consideration of functions of structural elements in the various embodiments of the present disclosure. However, meanings of the terms may be changed according to intention, a judicial precedence, the appearance of new technology, and the like. In addition, in certain cases, terms which are not commonly used may be selected. In such a case, the meanings of the terms will be described in detail at the corresponding portions in the following description of the embodiments. Therefore, the terms used in the various embodiments should be defined based on the meanings of the terms and the descriptions provided herein.

The term 'homogenized tobacco material' denotes a material formed by agglomerating particulate tobacco.

The term 'gathered' used herein denotes that a tobacco material sheet is convoluted, folded, or otherwise compressed or constricted substantially transversely to the cylindrical axis of the rod, or that a rod is formed of concentrating tobacco shreds.

The heated aerosol-generating system is operated by heating an aerosol-forming substrate to generate an aerosol from the material of the substrate. The aerosol may be inhaled by a user. When the substrate including the rod described hereinafter is heated, the tobacco flavor is released from a sheet or shreds of tobacco material.

An aerosol-generating article including the rod described hereinafter may be provided.

Many aerosol-generating articles in which aerosol-forming substrates are heated rather than combusted have been previously proposed. In heated aerosol-generating articles, typically, an aerosol is generated by heat transfer from a heat source, such as a chemical, electrical or combustible heat source, to a physically separate aerosol-generating article which may be located within, around, or downstream of the heat source.

The term 'aerosol-generating substrate' used herein refers to a substrate formed of or including an aerosol-forming material capable of releasing volatile compounds when heated in order to generate the aerosol.

The rod described herein is particularly suited for use as an aerosol-generating substrate of heated aerosol-generating article. The aerosol-generating substrate of the heated aerosol-generating article generally has a significantly shorter rod length than a rod made of a combustible material of a conventional lit-end smoking article.

In an embodiment, the rod described herein may be used as an aerosol-generating substrate of a heated aerosol-generating article including a combustible heat source and an aerosol-generating substrate downstream of the combustible heat source.

The rod described herein may be used as an aerosol-generating substrate in a heated aerosol-generating article for use in an electrically operated aerosol-generating system in which the aerosol-generating substrate of the heated aerosol-generating article is heated by an electrical heat source.

A system including an electrically operated aerosol-generating device and an aerosol-generating article for use in the aerosol-generating device may be provided. The aerosol-generating article may include a rod or an aerosol-forming substrate described herein.

A rod in a preferred embodiment includes a sheet or shreds of homogenized tobacco material. The sheet or shreds of homogenized tobacco material may be formed by agglomerating particulate tobacco obtained by grinding or otherwise by powdering of one or both of tobacco sheet lamina and tobacco sheet stems. Optionally or additionally, a sheet or shreds of homogenized tobacco material may include one or more tobacco dust, tobacco fines, and other particulate tobacco by-products formed, for example, during treating, handling and shipping of tobacco. When the rod according to the present disclosure is for use as an aerosol-forming substrate in a heated aerosol-generating article, the homogenized tobacco material used to form the rod may include, preferably, particulates obtained by grinding or otherwise comminuting tobacco sheet lamina.

In certain embodiments, the sheet of homogenized tobacco material may have a tobacco content of at least about 40 wt % on a dry weight basis or at least about 50 wt % on a dry weight basis. In another embodiment, the sheet of homogenized tobacco material may have a tobacco content of at least about 70 wt % on a dry weight basis. When the rod according to the present disclosure is for use as an aerosol-forming substrate in a heated aerosol-generating article, the use of a homogenized tobacco material with a high tobacco content may be advantageous for generating an aerosol with enhanced tobacco flavor.

The homogenized tobacco material may include one or more endogenous binders that are tobacco endogenous binders, one or more exogenous binders that are tobacco exogenous binders, or a combination thereof to help agglomerate the particulate tobacco. Additionally or optionally, the homogenized tobacco material may include other additives. The additives may include, but not limited to, tobacco and non-tobacco fibers, an aerosol former, a wetting agent, a plasticizer, a flavoring agent, a filler, an aqueous and non-aqueous solvent, and combinations thereof.

For example, when the rod according to the present disclosure is for use as an aerosol-forming substrate in a heated aerosol-generating article, a sheet or shreds of the homogenized tobacco material for use in forming the rod described herein may have an aerosol former content of between about 5 wt % and about 30 wt % on a dry weight basis. The rod for use in an electrically operated aerosol-generating system with a heating element may preferably include an aerosol former of about 5% to about 30%. For the rod for use in an electrically operated aerosol-generating system with a heating element, the aerosol-former may preferably include glycerin.

The rod described herein may include gathered sheets or shreds of homogenized tobacco material wrapped by a porous wrapper or non-porous wrapper.

Embodiments of the present disclosure may further include texturing a first continuous sheet. For example, embodiments of the present disclosure may include crimping, embossing, perforating or otherwise texturing for the first continuous sheet before gathering the first continuous sheet together with a second continuous sheet.

In addition, in the case of using the shreds, the rod may be formed of the shreds supplied continuously, other than the continuous sheet.

The reconstituted tobacco for use in the heated aerosol-generating article includes only one type of reconstituted tobacco sheet manufacture by the paper-making process or the slurry process. However, in the method of manufacturing an aerosol-forming rod according to embodiments of the present disclosure, the physical properties and taste of a tobacco rod may be controlled by utilizing the sheet-specific characteristics of each process for manufacturing a reconstituted tobacco sheet, and by mixing two or more types of reconstituted tobacco sheets having different types, different physical properties, or different main components.

The reconstituted tobacco manufactured by the paper-making process has a porous structure in the sheet due to the process characteristics, and thus, the reconstituted tobacco manufactured by the paper-making process has a good porosity, a high combustion rate, and good filling power (cc/g). On the other hand, the reconstituted tobacco manufactured by the slurry process has a high sheet density due to the process characteristics. Therefore, the combustion speed and filling power (cc/g) of the reconstituted tobacco manufactured by the slurry process are low compared to those of the reconstituted tobacco manufactured by the paper-making process, but the retention characteristics of the flavor components and the content components contained in the raw material are good. Therefore, by utilizing these characteristics, it is possible to control the physical properties, for example, weight, hardness, combustion characteristics, etc. and taste of the cigarette rod.

Physical properties, tastes, and flavor components may be imparted to a cigarette rod by combining two or more kinds of reconstituted tobacco constituting the heated aerosol-generating article according to a type, a parameter of physical properties, and a content component of reconstituted tobacco. The type may be, for example, a paper-making type reconstituted tobacco, slurry-type reconstituted tobacco, or extrusion-type reconstituted tobacco. The parameter of physical properties may be, for example, thickness, basis weight, porosity, filling power, or formation. The content component may be, for example, nicotine, or sugar. The cigarette rod formed by the above combination manner may have various product characteristics due to differences in physical properties such as hardness, weight, combustion characteristics, porosity, and the like.

In addition, although the cigarette rod in the form of shreds may exhibit a non-uniform density tendency according to the length of the rod, the non-uniform density tendency may be reduced by using two or more types of reconstituted tobacco sheets having different densities.

Hereinafter, the embodiments of the present disclosure will be described in detail with reference to the accompanying drawings.

FIG. 1 is a diagram illustrating an example in which a cigarette 2 is inserted into a holder 1.

Referring to FIG. 1, the cigarette 2 may be inserted into the holder 1. When the cigarette 2 is inserted, a heater 130 is located inside the cigarette 2. Therefore, an aerosol-generating material of the cigarette 2 is heated by the heated heater 130, and thus, an aerosol is generated.

The cigarette 2 may have a shape similar to a general combustion type cigarette. For example, the cigarette 2 may be divided into a first portion 210 including an aerosol-generating material and a second portion 220 including a filter and the like.

The first portion 210 may be entirely inserted into the holder 1, and the second portion 220 may be exposed to the outside. Alternatively, only a portion of the first portion 210 may be inserted into the holder 1, or the first portion 210 and a portion of the second portion 220 may be inserted.

A user may inhale the aerosol in the state where the second part 220 is bitten by mouth. At this time, the aerosol is generated by the external air passing through the first portion 210, and the generated aerosol passes through the second portion 220 and is delivered to the user's mouth.

External air may be introduced through at least one air passage formed in the holder 1. Alternatively, external air may be introduced through at least one hole formed on the surface of the cigarette 2.

Figure 2:
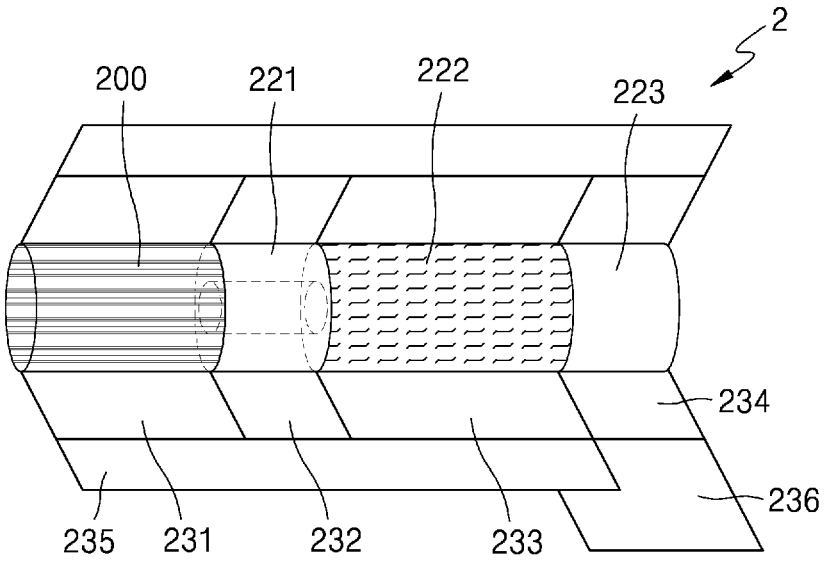
FIG. 2 is a block diagram illustrating an example of a cigarette.

FIG. 2 is a block diagram illustrating an example of a cigarette 2.

Referring to FIG. 2, the cigarette 2 includes a tobacco rod 200, a first filter segment 221, a cooling structure 222, and a second filter segment 223. The first portion described above with reference to FIG. 1 includes the tobacco rod 200, and the second portion described above with reference to FIG. 1 includes the first filter segment 221, the cooling structure 222, and the second filter segment 223.

Referring to FIG. 2, the cigarette 2 may be packaged by wrappers 231, 232, 233, 234, 235, and 236. For example, the tobacco rod 200 is packaged by a first wrapper 231 and the first filter segment 221 is packaged by a second wrapper 232. Also, the cooling structure 222 is packaged by a third wrapper 233, and the second filter segment 223 is packaged by a fourth wrapper 234.

The first wrapper 231, the second wrapper 232, and the third wrapper 233 may be wrapped by a fifth wrapper 235. In other words, the tobacco rod 200, the first filter segment 221, and the cooling structure 222 of the cigarette 2 may be further packaged by the fifth wrapper 235. Also, the fourth wrapper 234 and at least a portion of the fifth wrapper 235 may be wrapped by a sixth wrapper 236. In other words, at least a portion of the cooling structure 222 and the second filter segment 223 of the cigarette 2 may be further packaged by the sixth wrapper 236.

The first wrapper 231, the second wrapper 232, the fifth wrapper 235, and the sixth wrapper 236 may be made of general wrapping paper. For example, the first wrapper 231, the second wrapper 232, the fifth wrapper 235, and the sixth wrapper 236 may be porous wrapping paper or non-porous wrapping paper. For example, the thickness of the first wrapper 231 may be about 61 μm, the porosity of the first wrapper 231 may be about 15 CU, the thickness of the second wrapper 232 may be about 63 μm, and the porosity second wrapper 232 may be about 15 CU, but the present disclosure is not limited thereto. Further, the thickness of the fifth wrapper 236 may be about 66 μm, the porosity of the fifth wrapper 236 may be about 10 CU, and the thickness of the sixth wrapper 236 may be 66 μm and the porosity of the sixth wrapper 236 may be about 17 CU, but the present disclosure is not limited thereto.

In addition, an aluminum foil may be further included on the inner surfaces of the first wrapper 231 and/or the second wrapper 232.

The third wrapper 233 and the fourth wrapper 234 may be made of hard wrapping paper. For example, the thickness and porosity of the third wrapper 233 may be about 158 μm and about 33 CU, respectively, and the thickness and porosity of the fourth wrapper 234 may be about 155 μm and 46 CU, respectively, but the present disclosure is not limited thereto.

A predetermined material may be included in the fifth wrapper 235 and the sixth wrapper 236. Here, an example of the predetermined material may be, but is not limited to, silicon. For example, silicon exhibits characteristics like heat resistance with little change due to the temperature, oxidation resistance, resistances to various chemicals, water repellency or electrical insulation. However, any material other than silicon may be applied to (or coated on) the fifth wrapper 235 and the sixth wrapper 236 without limitation as long as the material exhibits the above-mentioned characteristics.

The fifth wrapper 235 and the sixth wrapper 346 may prevent the cigarette 2 from being burned. For example, when the tobacco rod 200 is heated by the heater 130, the cigarette 2 is likely to be burned. In detail, when the temperature is raised to a temperature above the ignition point of any one of materials included in the tobacco rod 200, the cigarette 2 may be burned. Even in this case, since the fifth wrapper 235 and the sixth wrapper 236 include a non-combustible material, the burning of the cigarette 2 may be prevented.

In addition, the fifth wrapper 235 may prevent the holder 1 from being contaminated by substances generated in the cigarette 2. By the user's puff, liquid substances may be generated in the cigarette 2. For example, as the aerosol generated in the cigarette 2 is cooled by external air, liquid substances (e.g., moisture, etc.) may be generated. As the fifth wrapper 235 wraps the tobacco rod 200 and/or the first filter segment 221, the liquid substances generated in the cigarette 2 may be prevented from leaking out of the cigarette 2. Therefore, the phenomenon that the inside of the holder 1 is contaminated by the liquid substances generated in the cigarette 2 may be prevented.

The diameter of the cigarette 2 is within the range of about 5 mm to about 9 mm, and the length of the cigarette 2 may be about 45 mm, but the present disclosure is not limited thereto. For example, the length of the tobacco rod 200 may be about 11.5 mm, the length of the first filter segment 221 may be about 8 mm, the length of the cooling structure 222 may be about 18.5 mm, and the length of the second filter segment 223 may be about 7 mm, but the present disclosure is not limited thereto.

The structure of the cigarette 2 shown in FIG. 2 is only an example, and some components may be omitted. For example, the cigarette 2 may not include one or more of the first filter segment 221, the cooling structure 222, and the second filter segment 223.

The tobacco rod 200 includes an aerosol-generating material. For example, the aerosol-generating material may include at least one of glycerin, propylene glycol, ethylene glycol, dipropylene glycol, diethylene glycol, triethylene glycol, tetraethylene glycol, and oleyl alcohol.

In addition, the tobacco rod 200 may contain other additives such as a flavoring agent, a wetting agent and/or an organic acid. For example, the flavoring agent may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, caraway, cognac, jasmine, chamomile, menthol, cassia bark, ylang, salvia, spearmint, ginger, coriander, coffee, or the like. In addition, the wetting agent may include glycerin, propylene glycol, or the like.

As an example, the tobacco rod 200 may be filled with a reconstituted tobacco sheet.

As another example, the tobacco rod 200 may be filled with tobacco shreds. The tobacco shreds may be produced by finely cutting the reconstituted tobacco sheet.

As another example, the tobacco rod 200 may be filled with a plurality of tobacco strands produced by fine-cutting the reconstituted tobacco sheet. For example, the tobacco rod 200 may be formed by combining a plurality of tobacco strands in the same direction (parallel to one another) or randomly.

For example, the reconstituted tobacco sheet may be manufactured by the following process. Firstly, a tobacco raw material is pulverized, and the pulverized tobacco raw material is mixed with an aerosol-generating material (for example, glycerin, propylene glycol, etc.), a flavoring liquid, a binder (for example, guar gum, xanthan gum, carboxymethyl cellulose (CMC), etc.), water, etc. to form a slurry. Then, the reconstituted tobacco sheet is formed by using the slurry. When making the slurry, natural pulp or cellulose may be added, and one or more binders may be mixed and used. On the other hand, tobacco strands may be produced by cutting or fine-cutting a dried reconstituted tobacco sheet.

The tobacco raw material may include tobacco leaf fragments, tobacco stems, and/or fine tobacco powders formed during treatment of tobacco. Also, the reconstituted tobacco sheet may include other additives such as wood cellulose fibers.

The slurry may contain about 5% to about 40% of an aerosol-generating material, and about 2% to about 35% of an aerosol-generating material may remain in the reconstituted tobacco sheet. In an embodiment, about 5% to about 30% of the aerosol-generating material may remain in the reconstituted tobacco sheet.

In addition, before the tobacco rod 200 is packaged by the first wrapper 231, a flavoring liquid, such as menthol or moisturizer, may be added by spraying the flavoring liquid onto a center portion of the tobacco rod 200.

The first filter segment 221 may be a cellulose acetate filter. For example, the first filter segment 221 may be a tube-shaped structure including a hollow inside. The length of the first filter segment 221 may be an appropriate length within the range of about 4 mm to about 30 mm, but the present disclosure is not limited thereto. Preferably, the length of the first filter segment 221 may be 8 mm, but the present disclosure is not limited thereto.

The diameter of the hollow included in the first filter segment 221 may be appropriately selected within the range of about 2 mm to about 4.5 mm, but the present disclosure is not limited thereto.

The hardness of the first filter segment 221 may be adjusted by adjusting the content of the plasticizer when manufacturing the first filter segment 221.

In addition, the first filter segment 221 may be manufactured by inserting a structure such as a tube or film of the same or different material into the first filter segment (e.g., into the hollow).

The first filter segment 221 may be manufactured by using cellulose acetate. Accordingly, when the heater 130 is inserted, the phenomenon that the internal material of the tobacco rod 200 is pushed back may be prevented, and an effect of cooling the aerosol may occur.

The cooling structure 222 cools the aerosol generated by heating the tobacco rod 200 by the heater 130. Therefore, the user may inhale the aerosol cooled to a suitable temperature.

The length or diameter of the cooling structure 222 may be variously determined according to the shape of the cigarette 2. For example, the length of the cooling structure 222 may be suitably selected within the range of 7 mm to 20 mm. Preferably, the length of the cooling structure 222 may be about 18.5 mm, but the present disclosure is not limited thereto.

The cooling structure 222 may be formed of a crimped polymer sheet. The polymer sheet may be fabricated by using a material selected from the group consisting of polyethylene (PE), polypropylene (PP), polyvinyl chloride (PVC), polyethylene terephthalate (PET), polylactic acid (PLA), cellulose acetate (CA) and aluminum foil. As the cooling structure 222 is formed of a crimped polymer sheet, the cooling structure 222 may include a plurality of channels extending in the longitudinal direction. The channel refers to a passage through which a gas, for example air or an aerosol, passes.

For example, the cooling structure 222 may be formed of a material having a thickness between about 5 μm and about 500 μm for example between about 10 μm and about 250 μm. In addition, the total surface area of the cooling structure 222 may be between about 300 $mm^2/mm$ and about 1000 $mm^2/mm$. Also, the aerosol cooling element may be formed from a material having a specific surface area of about 10 $mm^2/mg$ to about 100 $mm^2/mg$.

Meanwhile, the cooling structure 222 may include a thread containing a volatile flavor component. The volatile flavor component may include menthol, but the present disclosure is not limited thereto. For example, the thread may be filled with a sufficient amount of menthol to provide menthol of 1.5 mg or more to the cooling structure 222.

The second filter segment 223 may be a cellulose acetate filter. The length of the second filter segment 223 may be appropriately selected within a range of 4 mm to 20 mm. For example, the length of the second filter segment 223 may be about 7 mm, but the present disclosure is not limited thereto.

In the process of fabricating the second filter segment 223, flavoring liquid may be sprayed to the second filter segment 223 so that a flavor may occur. Alternatively, separate fibers coated with a flavoring liquid may be inserted into the second filter segment 223. The aerosol generated in the tobacco rod 200 is cooled as the aerosol passes through the cooling structure 222, and the cooled aerosol is delivered to the user through the second filter segment 223. Accordingly, when a flavoring element is added to the second filter segment 223, there may be an effect of enhancing the persistence of flavor delivered to the user.

Figure 3:
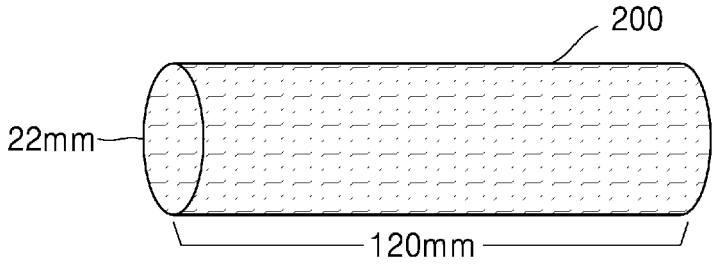
FIG. 3 is a diagram for explaining an aerosol-forming rod according to an embodiment.

FIG. 3 is a diagram for explaining a rod 210 which is filled according to an embodiment.

Referring to FIG. 3, the rod 210 may be filled with reconstituted tobacco sheets or shreds. The reconstituted tobacco sheets or shreds to be filled may be fabricated by various reconstituted tobacco sheet manufacturing processes. For example, the reconstituted tobacco sheet or shreds may be manufactured by a paper-making type reconstituted tobacco sheet manufacturing process, a slurry type reconstituted tobacco sheet manufacturing process, or an extrusion type reconstituted tobacco sheet manufacturing process, and may be manufactured by at least two reconstituted tobacco sheet manufacturing processes.

Although it has been described above that a rod is manufactured by mixing at least two reconstituted tobacco manufactured by using different reconstituted tobacco sheet manufacturing processes, the aerosol-forming rod may also be manufactured by mixing leaf tobacco shreds with the reconstituted tobacco manufactured by any one of the reconstituted tobacco sheet manufacturing processes described above. The leaf tobacco shreds may include flue-cured tobacco, burley tobacco, oriental tobacco, cigar leaves, toasted tobacco, and the like.

In addition, a heated aerosol-generating article may be manufactured by mixing leaf tobacco shreds and two types of reconstituted tobacco leaves manufactured by different reconstituted tobacco sheet manufacturing processes.

In embodiments, physical properties, tastes, and flavor components may be imparted to a cigarette rod by combining two or more types of reconstituted tobacco constituting the heated aerosol-generating article according to a type, a parameter of physical properties, and a content component of each constituent tobacco. The type may be, for example, a paper-making type reconstituted tobacco, slurry-type reconstituted tobacco, or extrusion-type reconstituted tobacco. The parameter of physical properties may be, for example, thickness, basis weight, porosity, filling power, or formation. The content component may be, for example, nicotine, or sugar.

Figure 4:
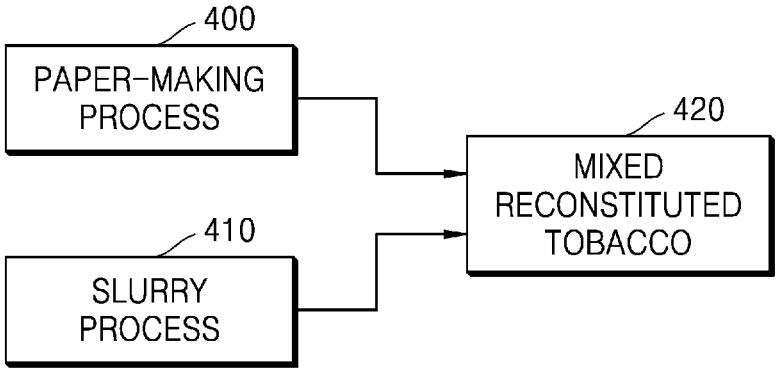
FIG. 4 is a schematic view illustrating a method of manufacturing an aerosol-forming rod according to an embodiment.

FIG. 4 is a schematic view illustrating a method of manufacturing an aerosol-forming rod according to an embodiment.

Referring to FIG. 4, a first reconstituted tobacco manufactured by the paper-making process 400 and a second reconstituted tobacco manufactured by the slurry process 410 are mixed at a predetermined ratio to manufacture a mixed reconstituted tobacco 420. Herein, the paper-making process and the slurry process have been described, but the present disclosure is not limited thereto, and any other reconstituted tobacco sheet manufacturing processes may be used.

The reconstituted tobacco manufactured by the paper-making process 400 has a porous structure in the sheet due to the process characteristics, and thus the reconstituted tobacco manufactured by the paper-making process 400 has a good porosity, a high combustion rate, and good filling power (cc/g). On the other hand, the reconstituted tobacco manufactured by the slurry process 410 has a high sheet density due to the process characteristics, so the combustion speed and filling power (cc/g) are low compared to the reconstituted tobacco manufactured by the paper-making process, but the retention characteristics of the flavor components and the content components contained in the raw material are good. Therefore, the physical properties of tobacco rod such as weight, hardness, combustion properties, and porosity, and taste, etc. may be controlled by utilizing these characteristics, by mixing a first reconstituted tobacco and a second reconstituted tobacco which are manufactured by different processes from the first reconstituted tobacco at a predetermined mixing ratio, for example, at least 10%.

The following Table 1 shows the results of testing the physical properties in a case where the mixing ratio of the reconstituted tobacco sheet manufactured by slurry process is 100% and in cases where the mixing ratio of the reconstituted tobacco sheet manufactured by the paper-making process or extrusion process is 30%. According to specific characteristics of each reconstituted tobacco sheet, the physical properties of the rods are different in rod weight, resistance-to-draw, and filling power.

TABLE 1

| reconstituted tobacco sheet mixing ratio | rod weight | resistance-to-draw | filling power (cc/g) |
|---|---|---|---|
| slurry type reconstituted tobacco sheet 100% | 1560 mg (1320 mg to 1920 mg) | 105 $mmH_2O$ (70 $mmH_2O$ to 180 $mmH_2O$) | 2.7 |
| mixing slurry type reconstituted tobacco sheet 70% and paper-making type reconstituted tobacco sheet 30% | 1200 mg (1000 mg to 1500 mg) | 110 $mmH_2O$ (80 $mmH_2O$ to 200 $mmH_2O$) | 3.2 |
| mixing slurry type reconstituted tobacco sheet 70% and extrusion type reconstituted tobacco sheet 30% | 1630 mg (1440 mg to 1800 mg) | 130 $mmH_2O$ (90 $mmH_2O$ to 190 $mmH_2O$) | 2.7 |

When the paper-making type reconstituted tobacco sheet is mixed in, the weight of the rod is reduced at the same rod volume due to the high filling power of the paper-making type reconstituted tobacco sheet, and the filling power of the mixed reconstituted tobacco sheets is improved. It may be seen that the resistance-to-draw increases when the extrusion type reconstituted tobacco sheet is mixed at a mixing ratio of 30% with the slurry type reconstituted tobacco sheet. Various aerosol-forming product properties may be realized by utilizing the sheet-specific properties of each reconstituted tobacco manufacturing process, and by using a mixture of two or more types of reconstituted tobacco sheets of different types, different physical properties, or different main components to control physical properties and tastes of the cigarette rod.

In the embodiment, although only the mixing of the reconstituted tobacco sheets or shreds was described, but the present disclosure is not limited thereto. For example, the physical properties and tastes of the rod may be controlled by using reconstituted tobacco sheet as a base and mixing it with leaf tobacco shreds at a mixing ratio of at least 10%. The leaf tobacco shreds may include flue-cured tobacco, burley tobacco, oriental tobacco, cigar sheets, toasted tobacco, and the like.

It has been described that reconstituted tobacco manufactured by using different reconstituted tobacco sheet manufacturing processes are mixed. However, the aerosol-forming rod may be manufactured by mixing reconstituted tobacco manufactured by any one of the reconstituted tobacco sheet manufacturing processes described above and leaf tobacco shreds at a predetermined mixing ratio. The aerosol-forming rod may be manufactured by using a mixed reconstituted tobacco including a reconstituted tobacco and leaf tobacco shreds of mixing ratio of about 10%. The leaf tobacco shreds may include at least one selected from flue-cured tobacco, burley tobacco, oriental tobacco, cigar leaves, and toasted tobacco. The mixing ratio of about 10% is exemplary, and the present disclosure is not limited thereto.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is disclosed in the appended claims rather than disclosed in the above description, and all differences within the scope of equivalents thereof should be construed as being included in the present disclosure.

What is claimed is:

1. A method of manufacturing an aerosol-forming rod that is configured to generate an aerosol via heating, the method comprising:

providing a first reconstituted tobacco sheet manufactured by a first reconstituted tobacco sheet manufacturing process including a slurry process and a second reconstituted tobacco sheet manufactured by a second reconstituted tobacco sheet manufacturing process including a paper-making process or an extrusion process; and manufacturing the aerosol-forming rod, which is configured to generate the aerosol via heating, by using a mixed reconstituted tobacco in which the first reconstituted tobacco sheet is mixed with the second reconstituted tobacco sheet at a predetermined mixing ratio, wherein the first reconstituted tobacco sheet manufactured by the slurry process is mixed at a mixing ratio of 70% to 90%, and the second reconstituted tobacco sheet manufactured by a paper-making process or an extrusion process is mixed at a mixing ratio in a range of 10% to 30%.

2. The method of claim 1, wherein physical properties of the aerosol-forming rod differ according to the predetermined mixing ratio.

3. The method of claim 2, wherein the physical properties include at least one from among thickness, basis weight, porosity, hardness, resistance-to-draw, and filling power.

4. The method of claim 1, wherein the second reconstituted tobacco sheet manufactured by the second reconstituted tobacco sheet manufacturing process is mixed at a mixing ratio of 30%, and the first reconstituted tobacco sheet manufactured by the first reconstituted tobacco sheet manufacturing process is mixed at a mixing ratio of 70%.

5. The method of claim 4, wherein the first reconstituted tobacco sheet manufacturing process is a slurry process, and the second reconstituted tobacco sheet manufacturing process is a paper-making process or an extrusion process.

6. The method of claim 1, wherein the first reconstituted tobacco sheet that is manufactured includes an aerosol-generating material.

7. The method of claim 6, wherein 2% to 35% of the first reconstituted tobacco sheet is the aerosol-generating material.

8. The method of claim 1, wherein the aerosol-forming rod does not include leaf tobacco shreds.

* * * * *